US006810531B1

(12) United States Patent
Lento

(10) Patent No.: US 6,810,531 B1
(45) Date of Patent: Nov. 2, 2004

(54) DRUM GLOVE

(76) Inventor: James A. Lento, 290 White Plains Rd., Eastchester, NY (US) 10709

( * ) Notice: Subject to any disclaimer, the term of this patent is extended or adjusted under 35 U.S.C. 154(b) by 0 days.

(21) Appl. No.: 10/658,538

(22) Filed: Sep. 10, 2003

(51) Int. Cl.[7] ..... A41D 19/00
(52) U.S. Cl. ..... 2/159; 2/16; 2/161.1
(58) Field of Search ..... 2/16, 20, 159, 2/160, 161.1, 161.2, 161.6; 294/15, 25, 26

(56) References Cited

U.S. PATENT DOCUMENTS

| | | | | |
|---|---|---|---|---|
| 2,272,333 A | | 2/1942 | Soderquist | |
| 2,294,997 A | * | 9/1942 | Merrion | 2/160 |
| 2,447,328 A | * | 8/1948 | Gerrits | 473/205 |
| 2,522,344 A | | 9/1950 | Carmin | |
| 3,170,703 A | | 2/1965 | Marchand | |
| 3,218,089 A | | 11/1965 | Marchand | |
| 3,918,097 A | | 11/1975 | Mlodoch | |
| 4,326,706 A | * | 4/1982 | Guthrie et al. | 482/105 |
| 4,504,980 A | * | 3/1985 | Butcher | 2/160 |
| 4,793,005 A | | 12/1988 | Hetzel, Jr. | |
| 5,018,221 A | * | 5/1991 | Romandetto | 2/16 |
| 5,088,121 A | * | 2/1992 | Wallace | 2/160 |
| D335,368 S | | 5/1993 | Houston | |
| 5,276,922 A | * | 1/1994 | Floyd, Jr. | 2/160 |
| D382,087 S | | 8/1997 | Arshed | |
| 5,742,942 A | | 4/1998 | Sykes | |
| 5,864,884 A | | 2/1999 | Salvitti | |
| 5,887,282 A | | 3/1999 | Lenhart | |
| 5,890,228 A | * | 4/1999 | Wagner | 2/160 |
| 5,943,701 A | * | 8/1999 | Seats | 2/160 |
| D414,311 S | * | 9/1999 | Westmoreland | D2/614 |
| 6,141,801 A | * | 11/2000 | Helenick | 2/159 |
| 6,209,138 B1 | | 4/2001 | Kang | |
| 6,286,148 B1 | | 9/2001 | Meyer | |
| 6,393,615 B1 | | 5/2002 | Bedell | |
| 6,408,442 B1 | | 6/2002 | Kang | |
| 6,427,248 B1 | | 8/2002 | Albert | |
| 6,553,574 B1 | * | 4/2003 | Hall et al. | 2/160 |

FOREIGN PATENT DOCUMENTS

| | | |
|---|---|---|
| JP | 6-173103 | 6/1994 |

* cited by examiner

*Primary Examiner*—Gary L. Welch
(74) *Attorney, Agent, or Firm*—Richard C. Litman

(57) ABSTRACT

The drum glove of the present invention is designed to allow the wearer to hold and properly align a drumstick in the hand. The glove has a sheath including a back covering and a palm covering for encasing the dorsal and ventral aspects of the hand, four tubular finger sleeves that are open-ended and permit the middle and distal phalanges to extend from the glove, a tubular thumb sleeve that is open-ended and permits the distal phalanx of the thumb to extend from the glove, and between one and three elastic bands extending across the palm covering. The elastic bands are designed to replicate and enhance the natural sticking motions of the drummer. The elastic bands allow the drummer to hold the drumsticks without unintentionally dropping them. The exposed portions of the fingers and thumbs allow the drummer to retain tactile contact with the sticks while playing.

9 Claims, 4 Drawing Sheets

DRUM GLOVE

BACKGROUND OF THE INVENTION

1. Field of the Invention

The present invention relates to gloves, and more particularly to gloves for use by drummers that are designed to allow the drummer to properly grasp and stabilize drumsticks.

2. Description of the Related Art

In order to properly play drums, a drummer must grasp the drumsticks and strike a drum with force. As a result, drummers of all skill levels face common problems, such as hand blistering, hand fatigue and unintentional dropping of drumsticks. Such problems put a strain on the drummer's hand and can hinder performance. Proper gripping and alignment of drumsticks in the hand is also an important part of learning to play the drums. With beginners especially, concentration on performance and technique is lost when one is still trying to gain comfort with holding a drumstick. Therefore, a need exists for a glove that will allow a drummer to both retain and feel the sticks in their hand as they play. Also a need exists for a glove that properly aligns drumsticks in a player's hands and, at the same time, reduces hand blistering. A further need exists for a glove that allows the drummer to hold the sticks without dropping them. Since the hands are the most used parts of the body, there are many gloves that have been developed to aid people in play, work and general life.

U.S. Pat. No. 5,864,884, issued to Salvitti on Feb. 2, 1999, describes a gun support glove. The glove exposes part of the thumb and fingers and has a two-piece strap on the palm of the glove. One part of the strap stretches from the crevice of the thumb to the palm area and the other part of the strap stretches from the ring finger to the palm area. The strap is quickly fastenable and releasable and it supports a gun even when it is not in use.

U.S. Pat. No. 6,286,148, issued to Meyer on Sep. 11, 2001, describes a glove having a single strap made of two parts. One strap part extends from the crevice of the thumb to either the center of the palm or the back of the hand. The other strap part extends from the outer edge of the palm near the wrist up to either the center of the palm or the back of the hand. The two strap parts are joined together by hook and loop fasteners or a buckle. The strap tightens so the glove securely fits the hand.

Gloves that have a single strap made of two parts are described in U.S. Pat. No. 2,522,344, issued to Carmin on Sep. 12, 1950 (buckled strap on glove spirals around an object) and U.S. Pat. No. 4,793,005, issued to Hetzel, Jr. on Dec. 27, 1988 (Velcro strap extends from the palm of the hand to the end of the tubular finger sleeves.)

Other gloves have a strap that forces the fingers into a closed position to provide a better grip over an object, as disclosed in U.S. Pat. No. 3,918,097, issued to Mlodoch on Nov. 11, 1975 (strap pivots over the upper back part of the fingers and is removably secured to the back of the hand) and U.S. Pat. No. 6,393,615, issued to Bedell on May 28, 2002 (buckled or hook and loop strap extends from the back of finger tips and connects to the back of the glove).

Still other gloves showing a strap are described in U.S. Pat. No. 5,742,942, issued to Skyes on Apr. 28, 1998 (glove having wrist strap); U.S. Pat. No. 5,887,282, issued to Lenhart on Mar. 30, 1999 (glove having a wrist strap to hold a pole); U.S. Pat. No. 2,272,333, issued to Soderquist on Feb. 10, 1942 (adjustable buckled loop strap lying across the knuckle of the glove); and U.S. Pat. No. 3,170,703 and U.S. Pat. No. 3,218,089, issued to Marchand on Feb. 23, 1965 and Nov. 16, 1965, respectively, (glove with a strap loop from the back of the hand to the palm area).

Several design patents show ornamental designs for gloves that expose the tips of the fingers and thumb, including U.S. Design Patent Number 335,368, issued to Houston on May 4, 1993 (support glove possessing a wrist strap and a patch in the palm) and U.S. Des. Patent Number 382,087, issued to Arshed on Aug. 12, 1997 (glove exposing a portion of the back of the hand).

Other gloves that assist in gripping objects are disclosed in U.S. Pat. No. 6,408,442, issued to Kang on Jun. 25, 2002 (anti-slip athletic gloves having a silicone coated surface); U.S. Pat. No. 6,209,138, issued to Kang on Apr. 3, 2001 (anti-slip athletic glove); U.S. Pat. No. 6,427,248, issued to Albert on Aug. 6, 2002 (grip enhancing glove having suction cups on finger tips and underside of thumb); and Japanese Patent Number 6-173,103 published on Jun. 6, 1994 (non-slip glove constructed of non-slip yarn).

None of the above inventions and patents, taken either singly or in combination, is seen to describe the instant invention as claimed. Thus a drum glove solving the aforementioned problems is desired.

SUMMARY OF THE INVENTION

The drum glove of the present invention is designed to allow the wearer to hold and properly align a drumstick in the hand. The glove has a sheath including a back covering and a palm covering for encasing the dorsal and ventral aspects of the hand, four tubular finger sleeves that are open-ended and permit the middle and distal phalanges to extend from the glove, a tubular thumb sleeve that is open-ended and permits the distal phalanx of the thumb to extend from the glove, and a number of elastic bands extending across the palm covering. The elastic bands allow the drummer to hold the drumsticks without unintentionally dropping them. The exposed portions of the fingers and thumbs allow the drummer to retain tactile contact with the sticks while playing.

The number of bands placed on the palm ranges from one to three depending on the type of grip desired by the drummer. The two main forms of grip are the "matched grip" and the "traditional grip". In the matched grip position both hands hold the drumsticks in the same "matched" up-right position. Each stick is gripped so the upper end exits out between the thumb and the first finger. The drum glove designed for use with the matched grip position uses three elastic bands across the palm and index finger of both gloves. The bands are particularly placed on one glove to mirror the image of the opposite hand.

Traditional grip is used for marching bands, or when preferred by the user. With the traditional grip position the left hand holds a drumstick in a writing position, such as when using a pen or pencil. In the traditional grip position the user would use three elastic bands on the superior hand and one band on the inferior hand. Professional level to intermediate level drummers have the option of just using two of the three bands on the superior hand; the two bands used by the drummer would be the band on the index finger and the middle band found on the palm of the glove. Both the single band construction and the multiple band construction function as flexible fulcrums, enhancing the play and performance of the drummer without unnecessary interference. Thus, using two bands as described on the superior hand acts as an alternative for intermediate to pro-level drummers. The two band construction provides greater flexibility and better stroke manipulation.

The drum glove is particularly useful for beginners in allowing them to concentrate on stroke technique, as opposed to the proper alignment of the sticks in their hands. Improper gripping hinders a student's learning curve and hampers musical growth. By alleviating the initial problem of proper alignment, the novice drummer is able to gain comfort in properly holding the sticks and mastering stroke techniques.

Accordingly, it is a principal object of the invention to provide a drum glove that properly aligns the sticks in the drummer's hand by providing the gloves with elastic bands for holding the sticks.

It is another object of the invention to provide a drum glove which improves grip while permitting the drummer to have a feel for the sticks while playing by having open-ended finger and thumb sleeves.

It is a further object of the invention to provide a drum glove that reduces hand blisters.

Still another object of the invention is to provide a drum glove that helps the drummer to retain the drumstick in order to avoid accidentally dropping the drumstick by retaining the sticks with elastic bands.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features

DETAILED DESCRIPTION OF THE PREFERRED EMBODIMENTS

Figure 1:
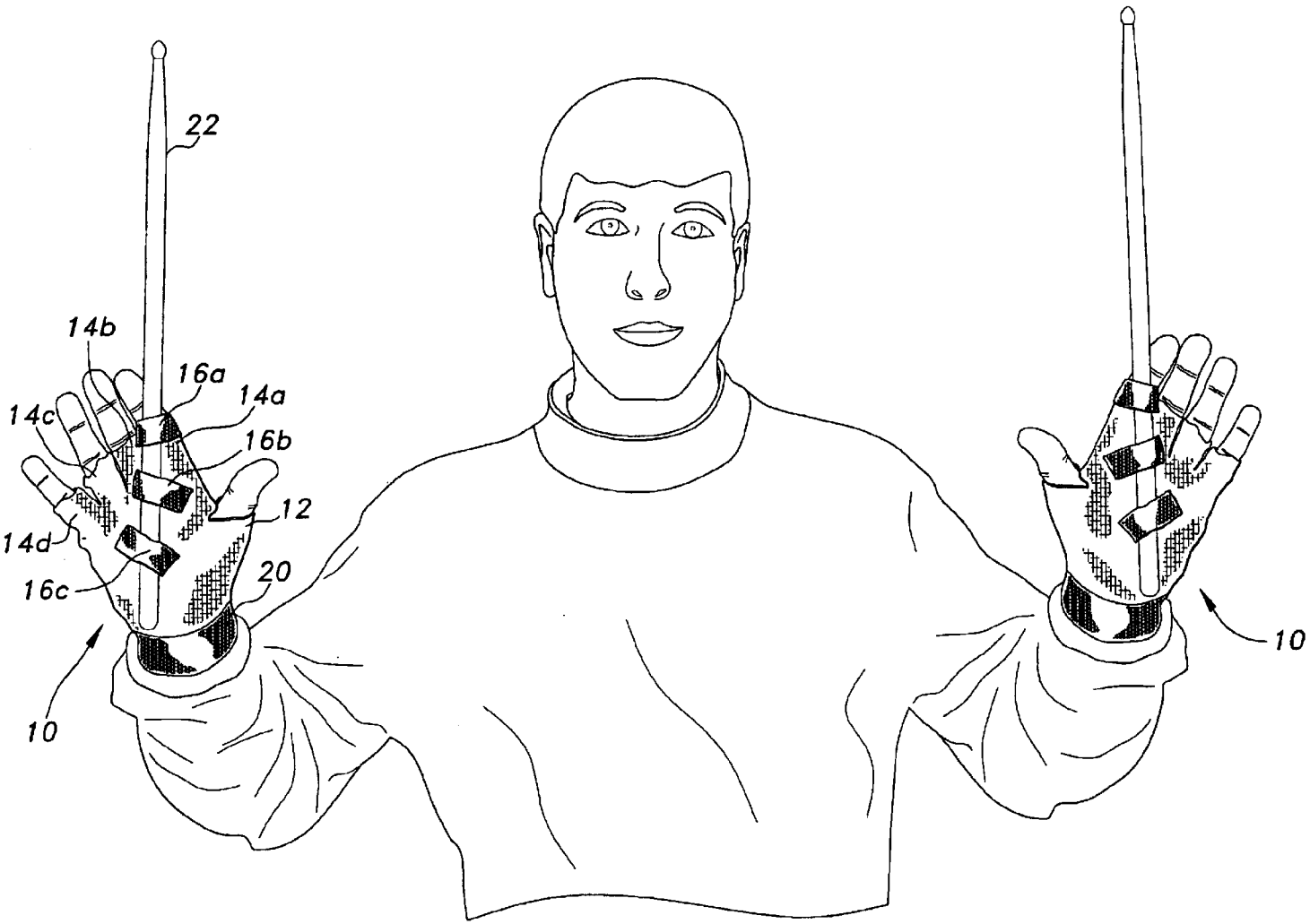
FIG. 1 is an environmental, perspective view of a drum glove according to the present invention.
Figure 2:
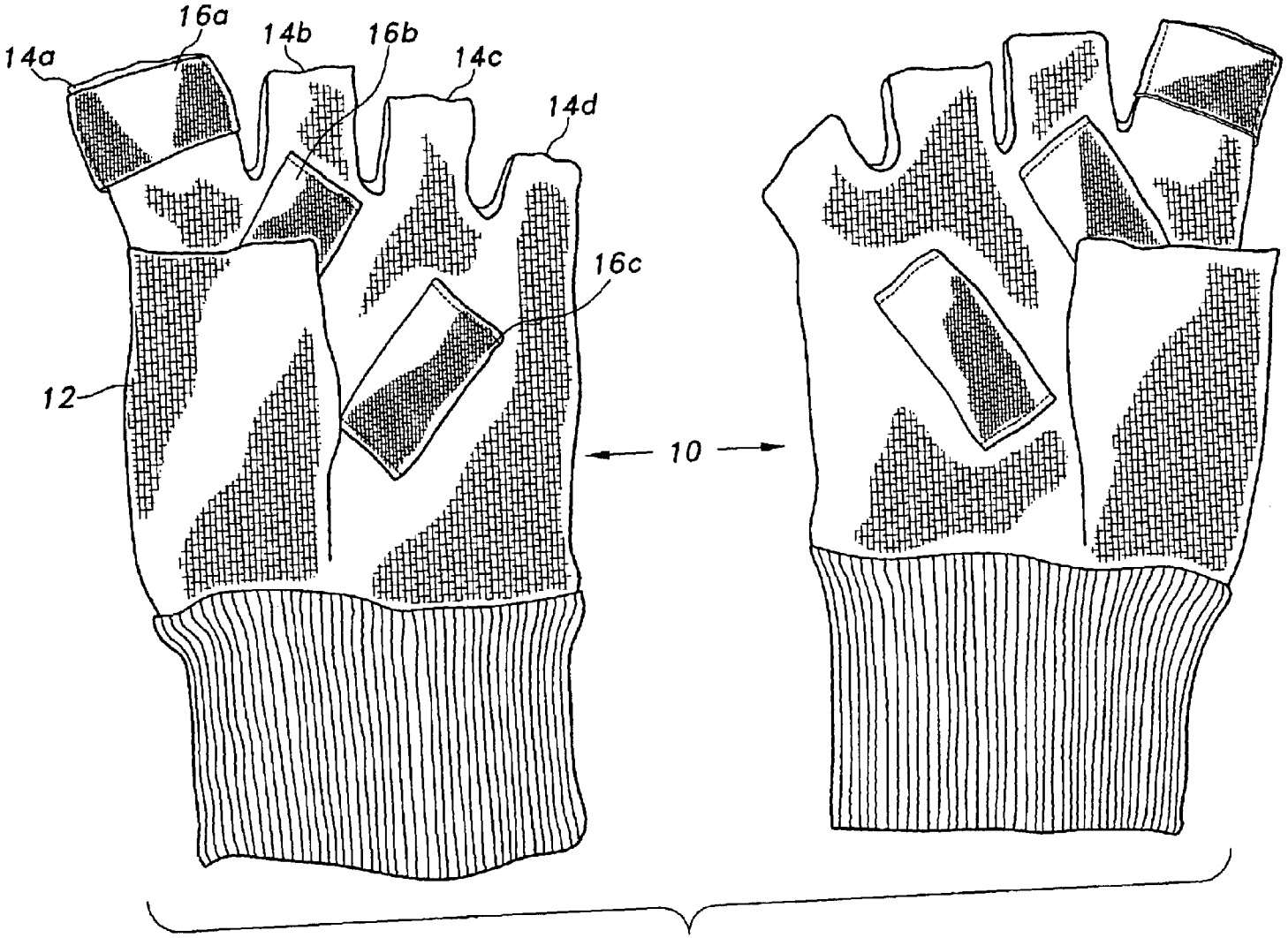
FIG. 2 is a front view of a pair of drum gloves according to the present invention.
Figure 3:
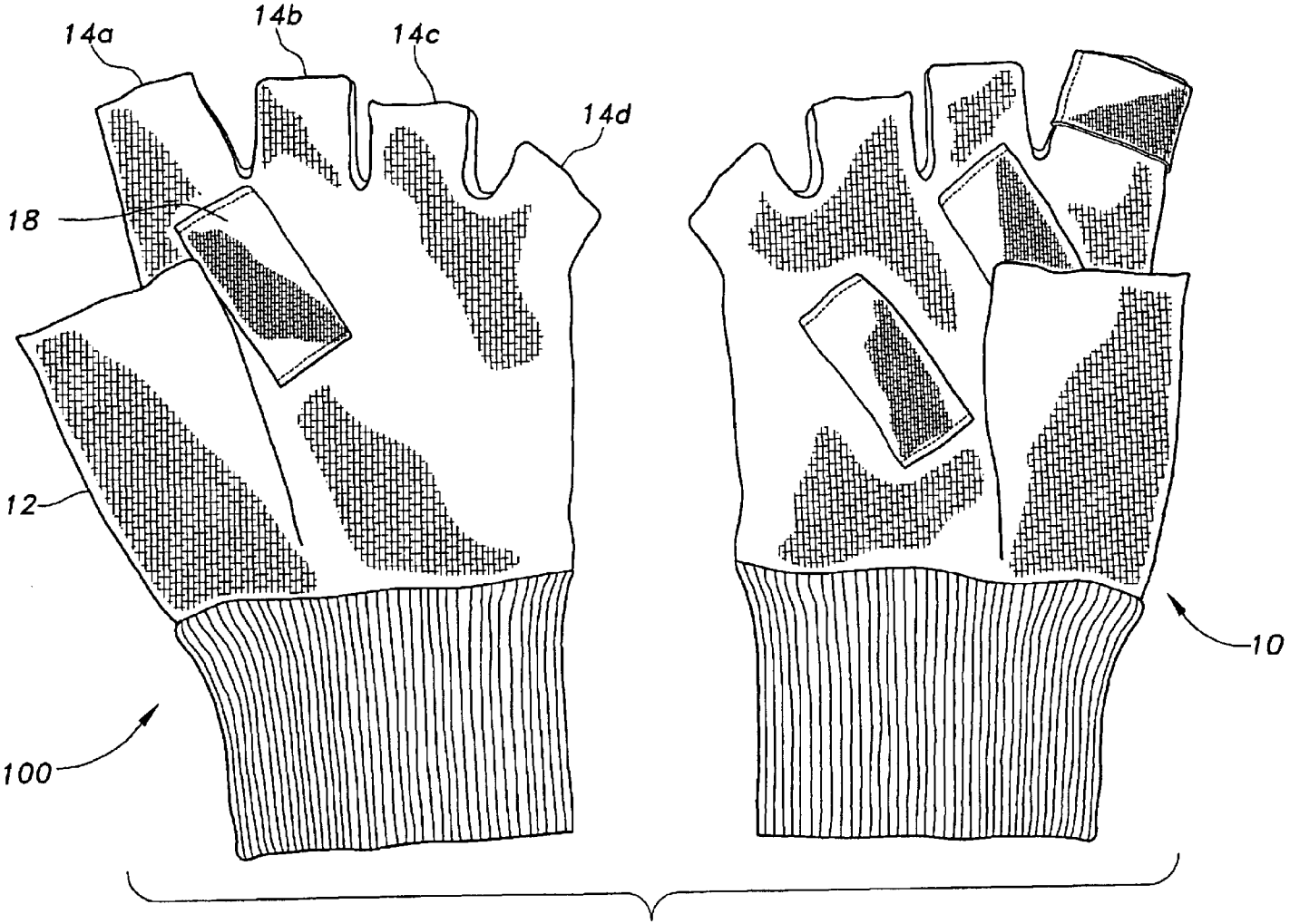
FIG. 3 is a front view of a pair of drum gloves according to the present invention, one glove having three elastic bands across the palm and index finger and the other having a single elastic band.
Figure 4:
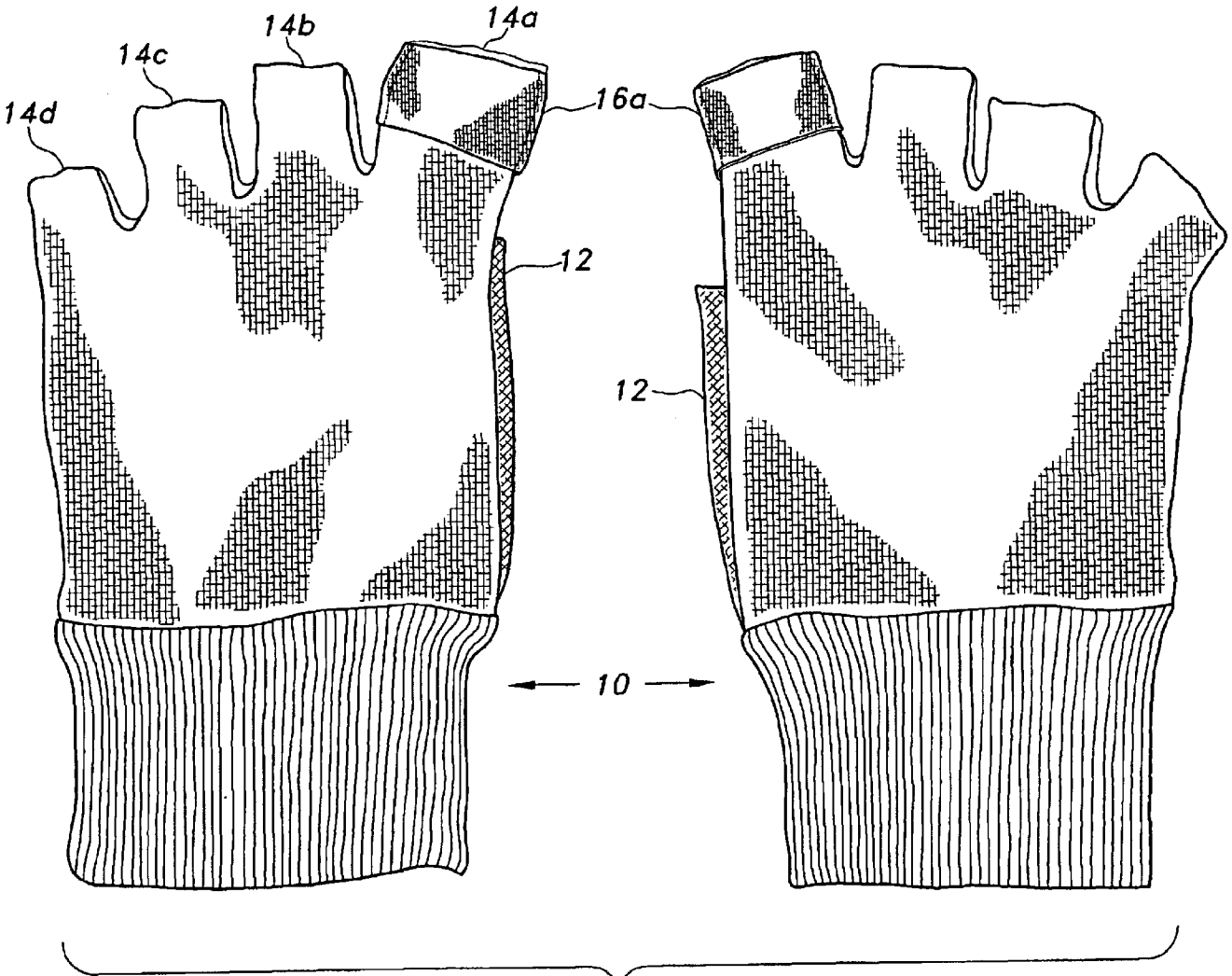
FIG. 4 is a rear view of a pair of drum glove according to the present invention.

The present invention is a drum glove, designated generally as 10 in FIGS. 1, 2, and 4, and as 100 in FIG. 3. The glove 10 can be made for both the left and right hands, as shown in FIG. 1. The glove 10 is formed as a sheath having a palm covering and a back covering joined to each other to encase the hand, and may include a wrist portion 20. The user in FIG. 1 shows drumsticks 22 being held in place by elastic bands 16*a*, 16*b*, 16*c*. The glove 10 lacks a thumb tip and finger tips, exposing part of the fingers and the thumb. The finger sleeves 14*a*, 14*b*, 14*c*, and 14*d* are open-ended, ending at about the proximal interphalangeal joint of each finger, leaving the middle and distal phalanges uncovered. The thumb sleeve 12 is also open-ended, ending at about the distal-proximal phalangeal joint, leaving the distal phalanx uncovered.

Referring now to FIG. 2, a pair of drum gloves 10 are shown to be mirror images of each other. Finger sleeves 14*a*, 14*b*, 14*c*, 14*d* are gradually cut at the proximal interphalangeal joint of each finger. Thumb sleeve 12 is cut between the distal-proximal phalangeal joint. FIG. 2 shows three bands extending across the ventral aspect of the glove 10. First elastic band 16*a* is secured to the first or index finger sleeve 14*a*. Second elastic band 16*b* is secured to the palm covering immediately under middle finger sleeve 14*b*. Second elastic band 16*b* is slanted; one end of the band faces the ring finger and the other end of the band points down toward the joint of the thumb.

Third elastic band 16*c* is secured to the palm covering of the glove 10 just under and between ring finger sleeve 14*c* and little finger sleeve 14*d*. Third elastic band 16*c* is slanted upward in the same direction and at the same angle as second elastic band 16*b*. One end of third elastic band 16*c* points up toward the tip of the little finger the other end points down toward the base of the wrist.

FIG. 4 displays the back side of a pair of drum gloves 10. FIG. 4 shows the back covering which covers the dorsal aspect of the hand, and the gradual cut off finger sleeves 14*a*, 14*b*, 14*c*, 14*d* and first elastic band 16*a* encircling first finger sleeve 14*a*.

Referring to FIG. 3, drum glove 100 is shown. Drum glove 100 is shown made for the left hand in FIG. 3, but can also be made for the right hand. Glove 100 in FIG. 3 exhibits one elastic band 18 that is secured to the palm area immediately under middle finger sleeve 14*b*. Elastic band 18 is slanted, one end of the band facing the tip of the index finger and the other end of the band being secured to the palm of the hand facing the outer edge of the wrist.

In use, the drummer dons the gloves 10 and 100, and inserts the drumsticks through the three elastic band 16*a*, 16*b*, and 16*c* of drum glove 10, or the single elastic band 18 of drum glove 100, as appropriate. The sticks may be grasped and aligned as described above, the bands 16*a*, 16*b*, 16*c*, and 18 serving to retain the sticks in the drummer's hands, the gloves 10 and 100 protecting the palms from blisters, and the open fingers 14*a*–14*d* and thumb 12 permitting the drummer to maintain proper grip pressure, traction and feel for the position, movement, and vibration of the sticks.

The number of bands placed on the palm ranges from one to three depending on the type of grip desired by the drummer. The two main forms of grip are the "matched grip" and the "traditional grip". In the matched grip position both hands hold the drumsticks in the same "matched" up-right position. Each stick is gripped so the upper end exits out between the thumb and the first finger. The drum glove designed for use with the matched grip position uses three elastic bands across the palm and index finger of both gloves. The bands are particularly placed on one glove to mirror the image of the opposite hand.

Traditional grip is used for marching bands, or when preferred by the user. With the traditional grip position the left hand holds a drumstick in a writing position, such as when using a pen or pencil. In the traditional grip position the user would use three elastic bands on the superior hand and one band on the inferior hand. Both the single band construction and the multiple band construction function as flexible fulcrums, enhancing the play and performance of the drummer without unnecessary interference. A two band construction can also be used as an alternative embodiment for intermediate to pro-level drummers. The two band construction provides greater flexibility and better stroke manipulation.

The drum glove is particularly useful for beginners in allowing them to concentrate on stroke technique, as opposed to the proper alignment of the sticks in their hands. Improper gripping hinders a student's learning curve and hampers musical growth. By alleviating the initial problem of proper alignment, the novice drummer is able to gain comfort in properly holding the sticks and mastering stroke techniques.

It is to be understood that the present invention is not limited to the embodiments described above, but encompasses any and all embodiments within the scope of the following claims.

I claim:

1. A drum glove for holding a drumstick comprising:

a back covering;

a palm covering, the palm covering being joined to the back covering in order to form a sheath adapted for encasing dorsal and ventral aspects of a hand;

a wrist portion extending from the sheath adapted for encircling a wrist;

a plurality of tubular finger sleeves extending from the sheath, including an index finger sleeve, the finger sleeves being open-ended and adapted for exposing middle and distal phalanges of a user's fingers;

a tubular thumb sleeve extending from the sheath, the thumb sleeve being open-ended and adapted for exposing a distal phalanx of the user's thumb;

at least one elastic band extending diagonally across the palm covering for retaining the drumstick to the glove; and an additional elastic band attached to the index finger sleeve for retaining the drumstick to the glove.

2. A drum glove as claimed in claim 1, wherein said at least one said elastic band comprises two elastic bands extending diagonally across the palm covering.

3. A drum glove as claimed in claim 1, wherein said at least one said elastic band consists of two elastic bands extending diagonally across the palm covering.

4. The drum glove according to claim 1, wherein said plurality of finger sleeves further comprises a middle finger sleeve, a ring finger sleeve, and a little finger sleeve.

5. A drum glove for holding a drumstick, comprising:

a sheath having a back covering, and a palm covering, the palm covering being joined to the back covering, the sheath for encasing a palm and a back of a hand;

a plurality of tubular finger sleeves extending from the sheath including an index finger sleeve, the finger sleeves being open-ended for exposing middle and distal phalanges of a user's fingers;

a tubular thumb sleeve extending from the sheath, the thumb sleeve being open-ended for exposing a distal phalanx of the user's thumb;

first and second elastic bands extending diagonally across the palm covering of the sheath for retaining the drumstick to the glove; and a third elastic band attached to the index finger sleeve for retaining the drumstick to the glove.

6. The drum glove according to claim 5, further comprising a wrist portion extending from the sheath adapted for encircling a wrist.

7. A pair of drum gloves, comprising:

a first drum glove, including:

a first sheath having a back covering and a palm covering, the palm covering being joined to the back covering, the first sheath for encasing a palm and a back of a first hand;

a plurality of tubular finger sleeves extending from the first sheath including an index finger sleeve, the finger sleeves being open-ended and for exposing middle and distal phalanges of a user's fingers;

a tubular thumb sleeve extending from the first sheath, the thumb sleeve being open-ended and for exposing a distal phalanx of the user's thumb;

first and second elastic bands extending diagonally across the palm covering of the first sheath for retaining a first drumstick to the first glove; and a third elastic band attached to the index finger sleeve for retaining the first drumstick to the first glove; and a second drum glove, including:

a second sheath having a back covering and a palm covering, the palm covering being joined to the back covering, the second sheath for encasing a palm and a back of a second hand;

a plurality of tubular finger sleeves extending from the second sheath including an index finger sleeve, the finger sleeves being open-ended for exposing middle and distal phalanges of the user's fingers;

a tubular thumb sleeve extending from the second sheath, the thumb sleeve being open-ended for exposing a distal phalanx of the user's thumb;

at least one elastic band extending diagonally across the palm covering of the second sheath for retaining a second drumstick to the second glove.

8. The pair of drum gloves of claim 7, wherein the second sheath further comprises a fourth elastic band attached to the index finger sleeve, and said at least one elastic band includes a fifth and sixth elastic bands extending diagonally across the palm covering of the second sheath, such that the first and second drum gloves are mirror images of each other.

9. The pair of drum gloves of claim 7, wherein said at least one elastic band consists of a single elastic band extending diagonally across the palm covering of the second sheath.

* * * * *